US005857630A

United States Patent [19]

Hamaguchi et al.

[11] Patent Number: 5,857,630

[45] Date of Patent: Jan. 12, 1999

[54] JAW CRUSHER

[75] Inventors: Masaki Hamaguchi; Masayuki Kano; Wataru Taga; Hideyuki Inayoshi; Shoji Inomata, all of Takasago, Japan

[73] Assignee: Kabushiki Kaisha Kobe Seiko Sho, Kobe, Japan

[21] Appl. No.: 835,644

[22] Filed: Apr. 11, 1997

[30] Foreign Application Priority Data

Apr. 12, 1996 [JP] Japan ..... 8-091241

[51] Int. Cl.[6] ..... B02C 1/02

[52] U.S. Cl. ..... 241/259.1; 241/264; 241/267

[58] Field of Search ..... 241/259.1, 259.2, 241/259.3, 264, 269

[56] References Cited

U.S. PATENT DOCUMENTS 2,532,678 12/1950 Shelton ..... 241/269

*Primary Examiner*—Mark Rosenbaum

*Attorney, Agent, or Firm*—Oblon, Spivak, McClelland, Maier & Neustadt, P.C.

[57] ABSTRACT

There is provided a jaw crusher capable of making unnecessary repair of abrasion or settling of a contact surface between a side frame receiving plate provided on a side frame receiving a crushing reaction caused by crushing of rock or the like, and a toggle block wedge supporting the side frame receiving plate through a toggle block. A liner mounting groove 12*a* is provided in a lower surface of a side frame receiving plate 12, and a liner 15 comprising a pressure receiving plate 15*a* fitted in the liner mounting groove 12*a* and a vertical plate 15*b* in contact with a surface on the swing jaw side of the side frame receiving plate 12 is mounted on the side frame receiving plate 12 by use of a liner latch 16 having a portion in contact with the upper surface of the side frame receiving plate 12 and the surface on the counter swing jaw side so as to replace only the liner 15.

3 Claims, 5 Drawing Sheets

JAW CRUSHER

BACKGROUND OF THE INVENTION

1. Field of the Invention

The present invention relates to improvements in jaw crushers, and more specifically, to the technical field of the jaw crusher capable of shortening an operation stopping period resulting from repairs of a side frame receiving plate by making unnecessary repairs of the side frame receiving plate projected on a side frame of the jaw crusher and a toggle block wedge.

2. Description of the Related Art

As is well known, the crusher holds and masticates a material to be crushed such as rocks between cushing teeth of a fixed jaw plate and a swing jaw plate which repeatedly moves to and from the fixed jaw plate to crush the masticated material to be crushed to obtain a primary crushed product. A crushing reaction continues to be generated during the crushing of the material to be crushed. The crushing reaction is supported by a pair of side frames provided widthwise of the fixed jaw plate and the swing jaw plate.

More specifically, side frame receiving plates projecting on sides where the side frames are opposed are projected. When the side frame receiving plates adjust an outlet gap which is an outlet for the primary crushed product formed between the fixed jaw plate and the swing jaw plate (The adjustment of the outlet gap is carried out because the crushing teeth of the fixed jaw plate and the swing jaw plate wear due to the continuation of crushing the material to be crushed.), the side frame receiving plates are moved toward the swing jaw by an adjusting amount corresponding to the abrasion and fixed, and supported through a toggle block wedge on a toggle block mounted on a back frame provided on the counter fixed jaw side of the swing jaw through a shim which is a spacing adjusting plate.

The outlet gap is adjusted through the toggle plate intervened between the swing jaw and the toggle block. As the toggle block moved and fixed during the gap adjustment moves, the toggle block wedge is also moved. This is carried out by adjusting a length of a toggle block wedge bolt by mounting a nut. As is known, the jaw crushers include a single toggle jaw crusher and a double jaw crusher. The means for supporting the crushing reaction is the same.

Accordingly, since the side frame receiving plate projected on the side frame and the toggle block wedge keeps supporting the crushing reaction caused by vibrations during the crushing the material to be crushed, the abrasion and settling are generated in the contact surface between the side frame receiving plate and the toggle block wedge. That is, the surface pressure is not even according to the processing accuracy of the side frame receiving plate and the toggle block wedge, and at a part where the surface pressure is high, fretting is so promoted that the part is not evenly worn but partially worn. When the operation is kept continuing under such a state, the toggle block wedge becomes damaged. It is therefore necessary to repair the contact surface between the side frame receiving plate and the toggle block wedge.

It will suffice that normally, the repair of the contact surface between the side frame receiving plate and the toggle block wedge is done once a few years. However, it is necessary for the repair to disassemble and assemble many parts such as a toggle block, a toggle plate and the like so that the operation of the jaw crusher has to be stopped for a long period, for example, several days. Therefore, an eager demand has been made for simplification and time-shortening of the repair. That is, even if it will suffice that the repair is made once a few years, but the jaw crusher is an apparatus at most upstream of the final crushed product whereby as the jaw crusher stops its operation, the operation of many equipments such as a downstream conveyor, a secondary crusher for producing final crushed product, and the like need be stopped.

It is therefore an object of the present invention to provide a jaw crusher capable of repairing the contact surface between a side frame receiving plate and a toggle block wedge easily and in a short period of time.

SUMMARY OF THE INVENTION

For solving the aforementioned problems, according the present invention, there is provided a jaw crusher comprising a fixed jaw plate, a swing jaw plate, a movable portion moved to adjust an outlet gap between the fixed jaw plate and the swing jaw plate, a side frame, a side frame receiving plate projected on the side frame, and a liner intervened between the movable portion and the side frame receiving plate so that an area in contact with the side frame receiving plate is larger than an area in contact with the movable portion. A crushing reaction caused by crushing materials to be crushed by the fixed jaw plate and the swing jaw plate is supported by the side frame receiving plate, the liner and the movable portion.

The jaw crusher according to the present invention further comprises a toggle block having a wedge contact surface inclined so that an extreme end is lower than a proximal end, the toggle block being moved to adjust an outlet gap between the fixed jaw plate and the swing jaw plate. A toggle block wedge in contact with the toggle block at the wedge contact surface is provided, the toggle block wedge corresponding to the movable portion.

Further, in the jaw crusher according to the present invention, the liner is detachably mounted thereon.

DETAILED DESCRIPTION OF THE EMBODIMENTS

Figure 2A:
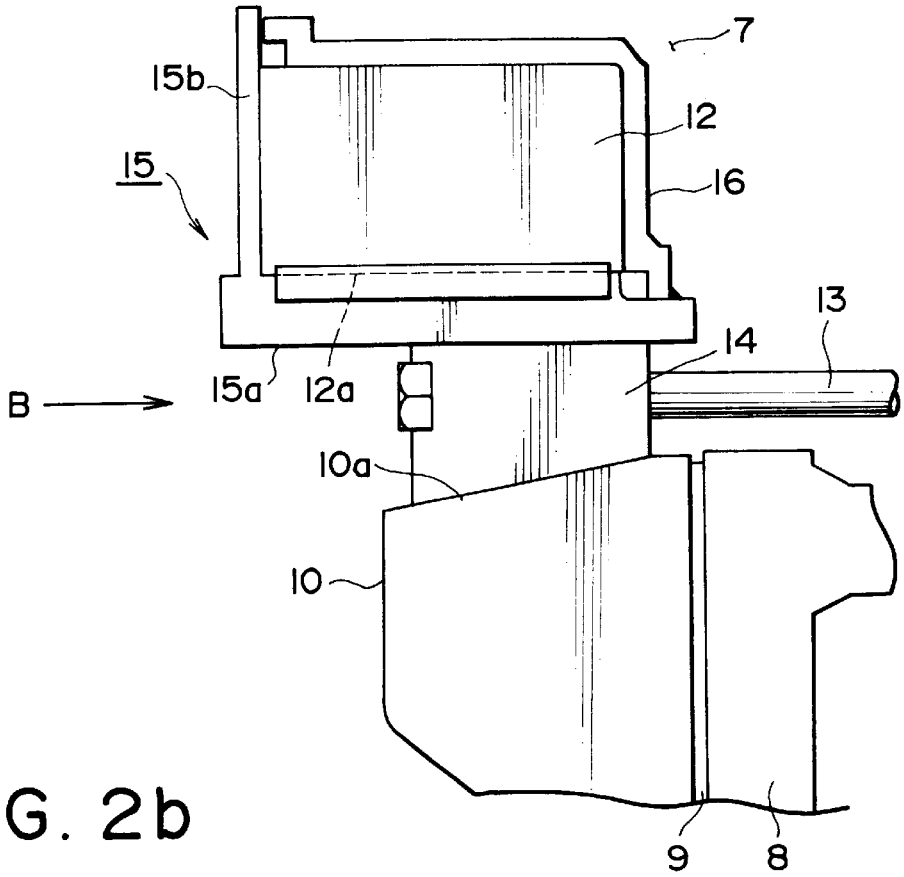
FIG. 2(*a*) is an enlarged view of a portion A in FIG. 1, and FIG. 2(*b*) is a view taken on B in FIG. 2(*a*)
Figure 2B:
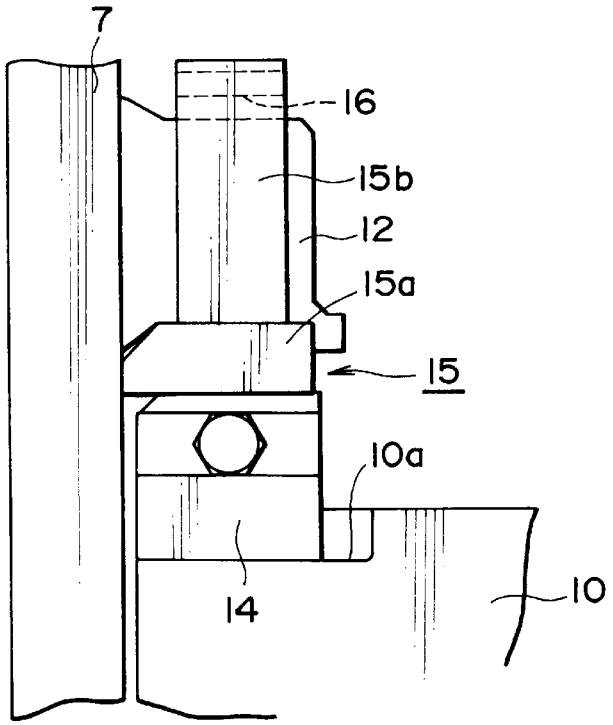
Figure 3A:
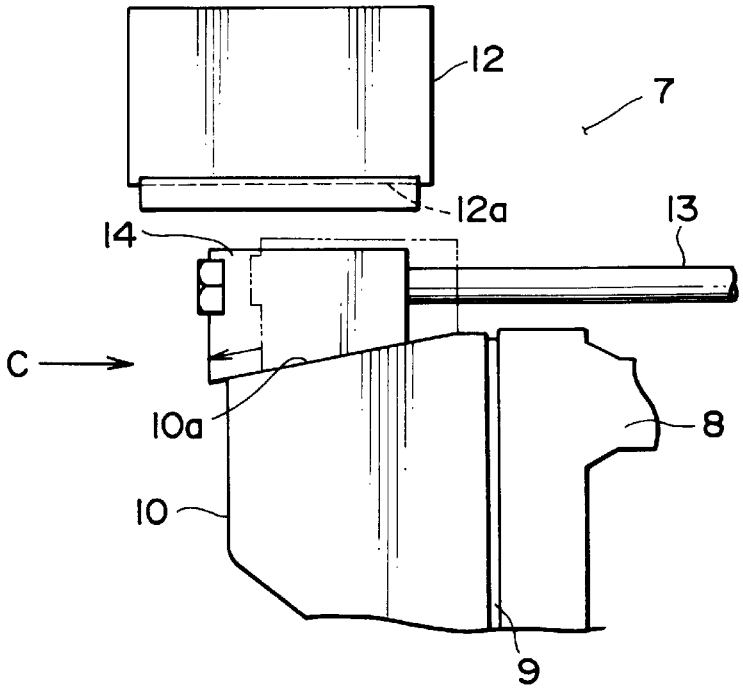
FIGS. 3(*a*) and 3(*b*) are respectively explanatory views of a procedure for mounting a liner.
Figure 3B:
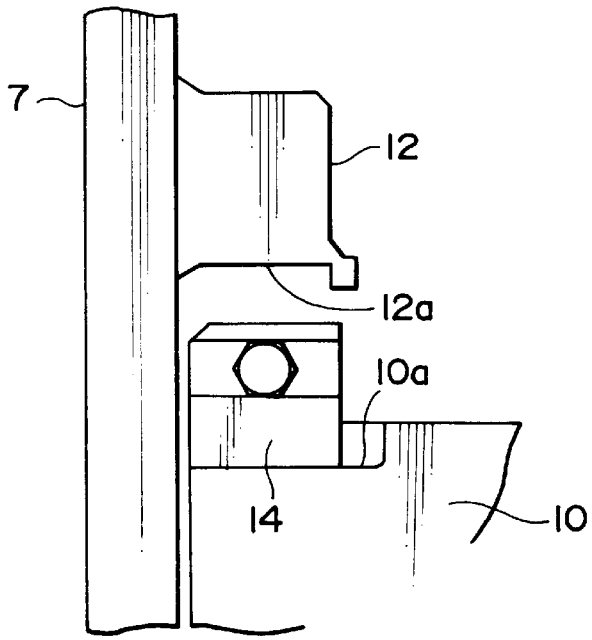
Figure 4A:
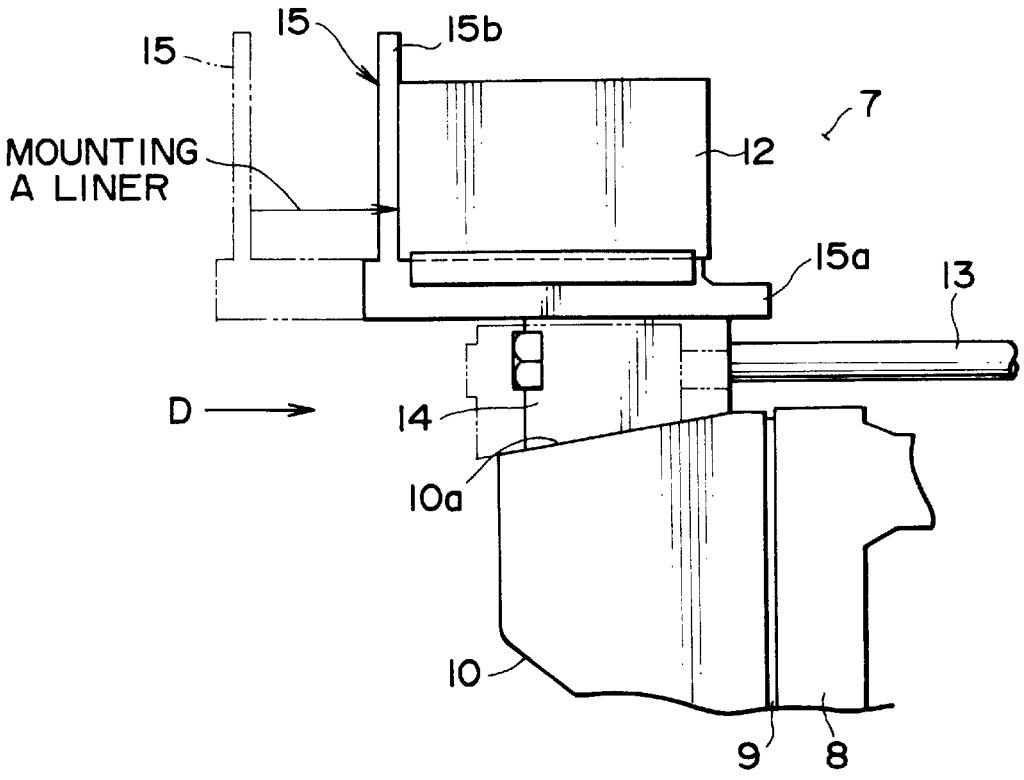
FIGS. 4(*a*) and 4(*b*) are respectively explanatory views of a procedure for mounting a liner.
Figure 4B:
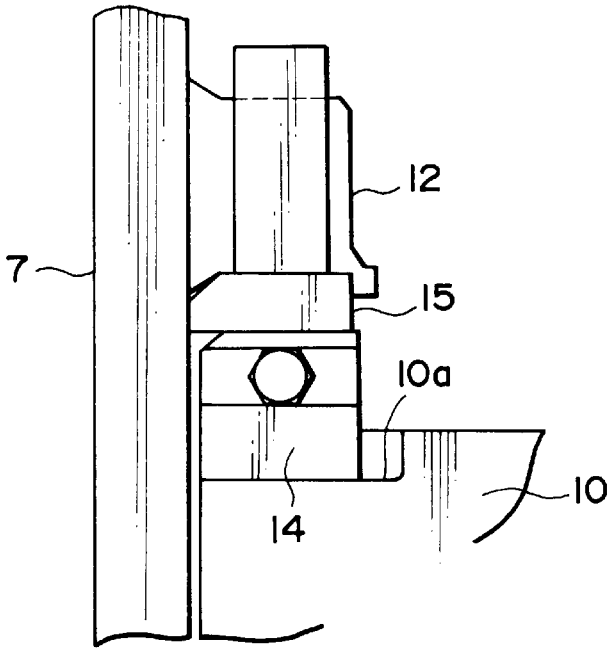
Figure 5A:
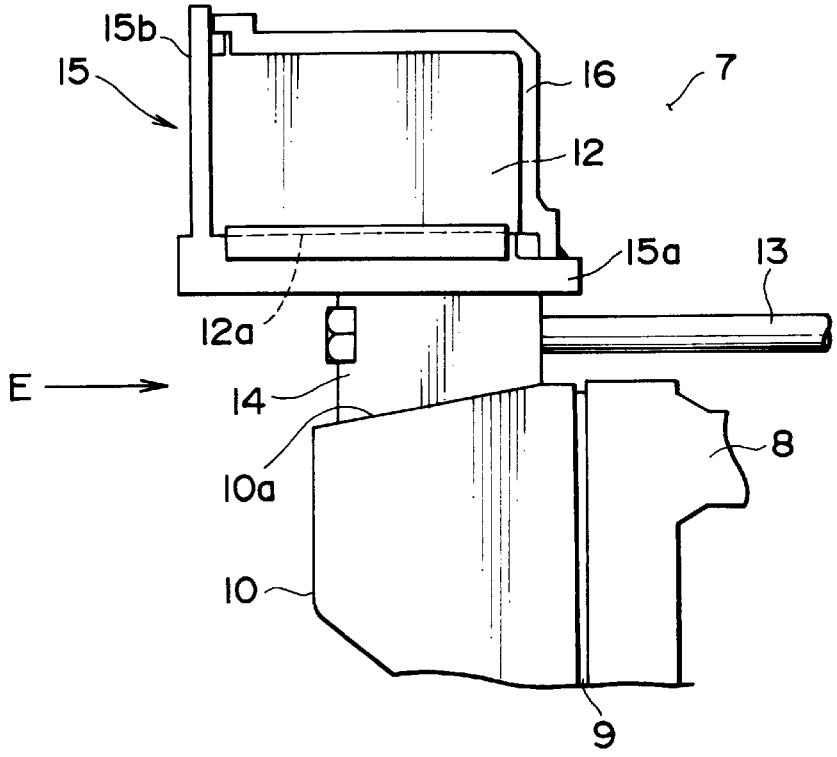
FIGS. 5(*a*) and 5(*b*) are respectively explanatory views of a procedure for mounting a liner.
Figure 5B:
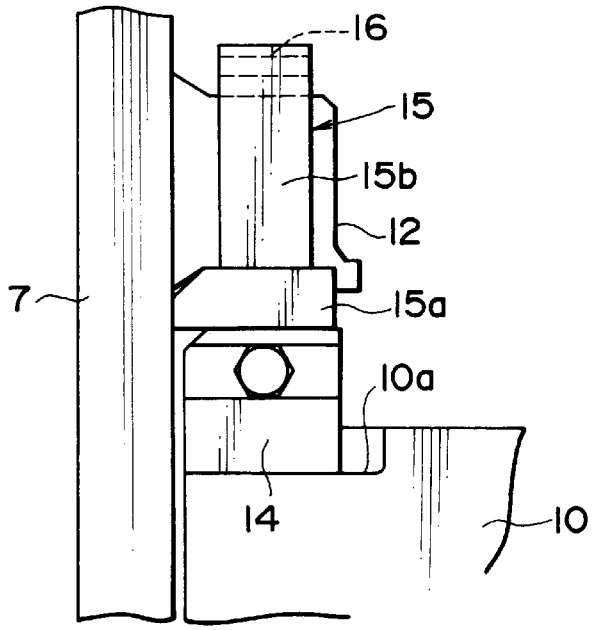

The jaw crusher in the form of a single jaw crusher according to an embodiment of the present invention will be described hereinafter with reference to FIG. 1 being an explanatory view of the constitution of a side section; FIG. 2(*a*) being an enlarged view of a portion A in FIG. 1, and FIG. 2(*b*) being a view taken on B in FIG. 2(*a*); FIG. 3(*a*) being an explanatory view of a procedure for mounting a liner; FIG. 3(*b*) being a view taken on C in FIG. 3(*a*); FIG. 4(*a*) being an explanatory view of a procedure for mounting a liner; FIG. 4(*b*) being a view taken on D in FIG. 4(*a*); and FIG. 5(*a*) being an explanatory view of a procedure for mounting a liner; FIG. 5(*b*) being a view taken on E in FIG. 5(*a*).

Figure 1:
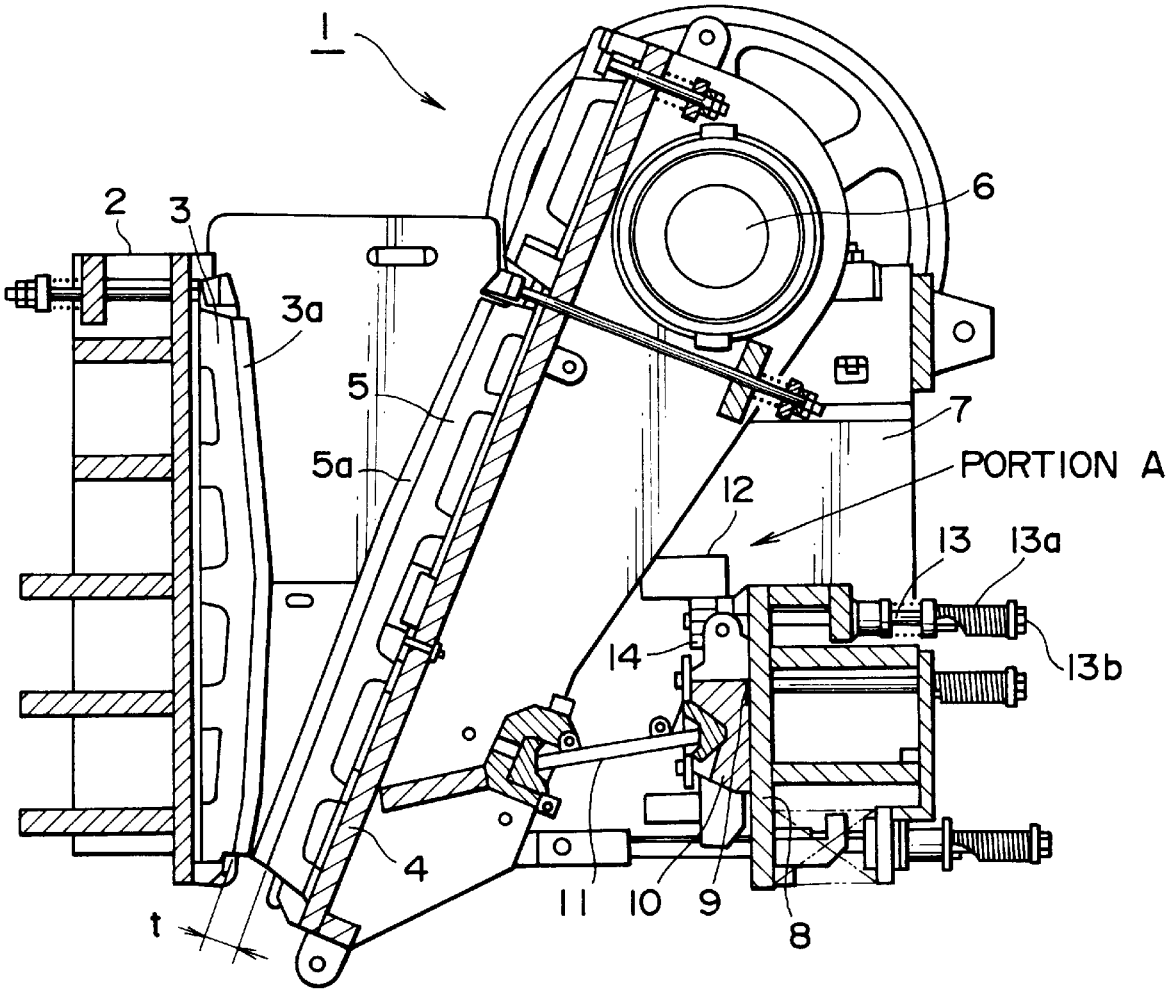
FIG. 1 is an explanatory view of the constitution of a side section of a jaw crusher according to an embodiment of the present invention.

Reference numeral 1 shown in FIG. 1 designates a jaw crusher. The jaw crusher 1 has a fixed jaw plate 3 vertically fixed to a front frame 2 with crushing teeth 3*a* directed at the counter front frame 2 side. There is provided a swing jaw 4 having a swing jaw plate 5 secured thereto with crushing teeth 5*a* directed at the fixed jaw plate 3 side, the swing jaw 4 being repeatedly moved to and from the fixed jaw plate 3 upon rotation of an upper eccentric shaft 6. A back frame 8 having a hollow portion is disposed on the counter swing jaw plate 5 of the swing jaw 4, and a toggle block 10 having a contact surface 10*a* supporting a toggle block wedge described later, which toggle block 10 is inclined so that an extreme end on the swing jaw 4 is lower than a proximal end on the back frame side, is secured on the swing jaw 4 side of the back frame 8 through a shim 9 as a spacing adjusting plate.

Side frames 7 (only one of which is shown, the side frame on this side in the figure is not shown) are provided on both sides widthwise of the fixed jaw plate 3 and the swing jaw plate 5, and side frames 12 which project in a direction opposed to each other, have a rectangular section and are constituted as described later, are projected at a position of the counter swing jaw 4 of the side frame 7 and at substantially an intermediate position in a vertical direction.

The side frame 12 is formed at the lower surface with a liner mounting groove 12*a* having a flat bottom, as shown in FIG. 2. An L-shaped liner 15 comprising a pressure receiving plate 15*a* mounted while being slidably moved in a lateral direction and a vertical plate 15*b* is disposed in the liner mounting groove 12*a* so that the pressure receiving plate 15*a* is fitted in the liner mounting groove 12*a* and a vertical surface of the vertical plate 15*b* comes in contact with the surface on the swing jaw 4 side of the side frame receiving plate 12. An extreme end of the pressure receiving plate 15*a* and an extreme end of the vertical plate 15*b* of the line 15 have an L-shape, which are welded to an extreme end of a liner latch 16 in contact with the upper surface of the side frame receiving plate 12 and the surface on the counter swing jaw 4 side of the side frame receiving plate 12 whereby the liner 15 is mounted on the side frame receiving plate 12.

Further, between a wedge contact surface 10*a* of the toggle block 10 and the lower surface of the liner 15 is disposed a toggle block wedge 14 which is moved toward the swing jaw 4 and held at a predetermined position by adjusting a length of a wedge bolt 13 in which a nut 13*b* is threadedly mounted on the back frame 8 through a coil spring 13*a*. A crushing reaction caused by crushing materials to be crushed such as rocks is transmitted to the wedge contact surface 10*a* of the toggle block 10 through the side frame receiving plate 12 and the liner 15, the crushing reaction being assigned by the toggle block 10. Reference numeral 11 designates a toggle plate for moving a lower portion of the swing jaw 4 toward the fixed jaw plate 3 by an adjusting and moving amount of the toggle block 10 caused by a shim 9 in the adjustment of an outlet gap t which is a gap between opposed lower sides of the fixed jaw plate 3 and the swing jaw plate 5.

The function will be described hereinafter. Fretting occurs in the contact surface between the liner 15 and the toggle block wedge 14 by the continuation of operation of the jaw crusher 1. Fretting is hard to occur in the contact surface between the liner 15 and the side frame receiving plate 12 because an area of the liner 15 is wider than that of the toggle block wedge 14 to be a surface pressure which is lower than that of the contact surface between the liner 15 and the toggle block wedge 14, thus suppressing the progress of damages of the surface of the side frame receiving plate 12.

That is, when the damage of the surface of the liner 15 progresses, only the liner 15 may be replaced. Moreover, the liner 15 may be replaced merely by removing a welded portion between the liner 15 and the liner latch 16 and pulling out the liner 15 from the liner mounting groove 12*a* of the side frame receiving plate 12. When the liner 15 is mounted, the operation reversed to the former may be done. Thus, when the liner 15 is replaced, it is not necessary to remove the toggle block, the toggle plate and the like as in prior art.

Next, the procedure for mounting the liner 15 on the side frame receiving plate 12 will be described in detail with reference to FIGS. 3, 4 and 5.

(1) First, as shown in FIGS. 3(*a*) and 3(*b*), a nut not shown is removed, and the wedge bolt 13 is allowed to move such that the toggle block wedge 14 slides downward across the contact face 10*a* toward the swing jaw 4, thereby creating a gap between the lower surface of the side frame receiving plate 12 and the upper surface of the toggle block wedge 14.

(2) Then, as shown in FIGS. 4(*a*) and 4(*b*), the pressure receiving plate 15*a* of the liner 15 is fitted in the liner mounting groove 12*a* of the side frame receiving plate 12 in a manner so as to be inserted in a lateral direction of a longitudinal direction of the jaw crusher, and the nut not shown is threadedly mounted to shorten the length of the wedge bolt 13 to thereby move the toggle block wedge 14 toward the back frame 8. Then, as the moving amount increases, the spacing between the lower surface of the side frame receiving plate 12 and the upper surface of the toggle block wedge 14 is gradually narrowed and the lower surface of the side frame receiving plate 12 and the upper surface of the toggle block wedge 14 come in contact with each other.

(3) As shown in FIGS. 5(*a*) and 5(*b*), the liner latch 16 is put from the upper side of the side frame receiving plate 12, and the extreme end of the portion in contact with the upper surface of the side frame receiving plate 12 of the liner latch 16 and the extreme end of the vertical plate 15*b* of the liner 15, and the extreme end of the portion in contact with the surface on the counter swing jaw 4 of the liner latch 16 and the extreme end of the pressure receiving portion 15*a* of the liner 15 are welded to complete the operation of mounting the liner 15 on the side frame receiving plate 12.

When for the purpose of replacement, the liner 15 is removed from the side frame 12, the length of the wedge bolt 13 is fist lengthened to move the toggle block wedge 14 toward the swing jaw 4, and the welded portion between the liner 14 and the liner latch 16 is removed by gouging or by a grinder.

As described above, according to the jaw crusher in the present embodiment, the liner 15 can be replaced without removing the toggle block 10, the toggle plate 11 and the like. Accordingly, when the abrasion or settling of the contact surface between the side frame receiving plate and the toggle block wedge is repaired, the operation stopping time of the jaw crusher 1 can be shortened as compared with the conventional jaw crusher which requires the removal of the toggle block, the toggle plate and the like, thus contributing to the enhancement of productivity of the primary crushed products in addition to the reduction in repair cost.

While in the foregoing, a technical idea of the present invention has been described by way of an example of being applied to the single toggle jaw crusher, it is to be noted that since the technical idea of the present invention can be also applied to the double jaw crusher constituted as is known, the scope of the technical idea of the present invention is not limited by the above-described embodiment.

As described above, the liner can be replaced without removing the toggle block, the toggle plate and the like. Accordingly, when the contact surface between the side frame receiving plate and the toggle block wedge is repaired, the operation stopping time of the jaw crusher can be shortened as compared with the conventional jaw crusher which requires the removal of the toggle block, the toggle plate and the like, thus providing excellent effects of greatly contributing to the enhancement of productivity of the crushed products in addition to the reduction in repair cost.

What is claimed is:

1. A jaw crusher comprising:

a fixed jaw plate, a swing jaw plate, a movable element moved to adjust an outlet gap between the fixed jaw plate and the swing jaw plate, a side frame, a side frame receiving plate projected on the side frame, and a liner intervened between the movable element and the side frame receiving plate so that an area of the liner in contact with said side frame receiving plate is larger than an area of the liner in contact with the movable element, a crushing reaction caused by crushing materials to be crushed by the fixed jaw plate and the swing jaw plate being supported by the side frame receiving plate, the liner and the movable element.

2. The jaw crusher according to claim 1 further comprising a toggle block having a wedge contact surface inclined so that an extreme end is lower than a proximal end, the toggle block being moved to adjust an outlet gap between the fixed jaw plate and the swing jaw plate, said movable portion comprising a toggle block wedge in contact with said toggle block at the wedge contact surface.

3. The jaw crusher according to claim 1, wherein said liner is detachably intervened.

* * * * *